US006540589B1

(12) United States Patent
Thiem et al.

(10) Patent No.: US 6,540,589 B1
(45) Date of Patent: Apr. 1, 2003

(54) METHOD AND DEVICE FOR ROUNDING EDGES

(75) Inventors: Matthias Thiem, Bamberg (DE); Johannes Amon, Ketschendorf (DE); Gerhard Schlereth, Schesslitz (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/869,604

(22) PCT Filed: Nov. 1, 2000

(86) PCT No.: PCT/DE00/03832

§ 371 (c)(1),
(2), (4) Date: Dec. 10, 2001

(87) PCT Pub. No.: WO01/32358

PCT Pub. Date: May 10, 2001

(30) Foreign Application Priority Data

Nov. 4, 1999 (DE) ..... 199 53 131

(51) Int. Cl.[7] ..... B24B 1/00

(52) U.S. Cl. ..... 451/36; 451/38; 451/61; 451/76

(58) Field of Search ..... 451/36, 38, 39, 451/40, 75, 76, 61, 446

(56) References Cited

U.S. PATENT DOCUMENTS

| | | | | | |
|---|---|---|---|---|---|
| 5,964,644 | A | * | 10/1999 | Rhoades | 451/40 |
| 6,086,459 | A | * | 7/2000 | Naegelin | 451/54 |
| 6,227,942 | B1 | * | 5/2001 | Hoffman | 451/36 |
| 6,273,787 | B1 | * | 8/2001 | Gilmore et al. | 451/36 |
| 6,288,154 | B1 | * | 9/2001 | Rhoades | 524/406 |

* cited by examiner

*Primary Examiner*—Eileen P. Morgan
(74) *Attorney, Agent, or Firm*—Ronald E. Greigg

(57) ABSTRACT

A method and an apparatus for rounding off edges are proposed in which an erosive fluid is pumped over the edge to round off edges even at poorly accessible places or where the geometry is complicated.

17 Claims, 3 Drawing Sheets

METHOD AND DEVICE FOR ROUNDING EDGES

BACKGROUND OF THE INVENTION

1. Field of the Invention

The invention relates to a method and an apparatus for rounding off edges.

2. Description of the Prior Art

In many component parts that are under heavy loads mechanically, thermally or in other ways, all kinds of peak stresses occur that entail the risk of failure of the component. It has long been known to at least partly abate these peak stresses by making undercuts and/or radii and thus to shift the load limit of the component upward. In many components, proceeding in this way has its limits, since the requisite cutting tools, such as lathe chisels, radius milling cutters, grinding bodies or the like require a certain amount of space, and this need cannot always be met. In fuel injection systems, for instance, various heavily loaded components are present that are inaccessible, or accessible only at major effort, to the above tools.

In other components, such as injection nozzles, the presence of edges that are rounded off in a defined way is important, in order to keep the flow resistance of the component within a narrow tolerance range. For this group of components as well, there has until now been no method or apparatus for rounding off the edges that are definitive for the flow resistance with high replicability and at little cost.

From U.S. Pat. No. 5,807,163, a method for rounding off the edges of the tiniest drilled bores, such as injection ports of injection nozzles, and for calibrating the tiniest bores is known. So-called flow grinding with a polymeric plastic composition is also known. Both methods are unsuited to removing the macroscopic burrs, created in the production of common rails for fuel injection systems, economically and rounding off the edges that are present.

It is the object of the invention to furnish a method with the aid of which edges can be rounded off even at inaccessible places, with high replicability and a high rate of removal of material and at favorable cost.

According to the invention, this object is attained by a method for rounding off edges in which the edge to be rounded off is bathed by an erosive fluid; between the pressures of the erosive fluid before and after the bathing of the edge to be rounded off, there is a pressure difference of from 50 bar to 140 bar.

SUMMARY OF THE INVENTION

The method of this invention has the advantage that edges that may be present at virtually arbitrary places in components, even if the edges are of complicated geometry, can be rounded off. The expense for equipment is tolerable, the machining time is short, and the rounding-off quality is high. Furthermore, only slight costs are entailed. By continuously measuring the quantity of the erosive fluid, high process reliability is gained. The removal of material is the greatest at edges, because of what as a rule is an elevated flow speed, so that at the other places subjected to the erosive fluid, no removal of material or only slight removal of material occurs. The flow behavior of the erosive fluid, in components experiencing a flow through them, such as high-pressure fuel reservoirs of fuel injection systems, is equivalent to that of the fuel in operation, so that the rounding off according to the invention at the same time brings about a desired artificial aging of the component.

In a variant of the method of the invention, the flow speed of the fluid in the region of the edge to be rounded off is elevated compared to the average flow speed of the fluid, so that an especially large amount of removal of material is attained in the region of the edge to be rounded off.

In a further feature of the method, a body is introduced into the fluid, the surface of which body forms a gap with the edge to be rounded off, so that the flow speed of the fluid in the region of the edge to be rounded off is increased still further compared to the average flow speed of the fluid, and thus the removal of material is increased further as well.

In an expansion of the method, it is provided that the flow direction of the fluid and the longitudinal axis of the edge to be rounded off form an angle, in particular of 90°, thus further intensifying the removal of material.

It has proved to be especially advantageous to use a suspension of a grinding agent in oil as the erosive fluid. This suspension makes a greater removal of material possible, compared to the use of a polymeric plastic composition. In addition, cleaning of the workpieces once the method has been performed is simplified considerably. Finally, by the use of a suspension instead of a plastic composition, the fluid flow during the machining can be measured and monitored in a simple way. Since the fluid flow is correlated with the removal of material at the edges to be rounded off, the progress of workpiece machining can be monitored continuously on the basis of it. This is important above all in large- scale mass production of workpieces with extreme precision. The method of the invention is thus more economical and can be more widely used.

The object stated at the outset is also attained by an apparatus for performing the method of having a feed pump for the erosive fluid, and having a hydraulic communication between the feed pump and the component whose edge is to be rounded off. This apparatus has the advantage that because of the hydraulic communication of the feed pump and the component, a flow of the erosive fluid, above all in the region of the edge to be rounded off, can be built up, the consequence of which is the rounding off of the edge.

In a variant of the invention, it is provided that a body forming a gap with the edge to be rounded off is present, so that the flow speed of the erosive fluid is elevated in the region of the edge to be rounded off, compared to the average flow speed of the erosive fluid, thus speeding up the rounding off of the edge.

In an expansion of the invention, a collector device for catching the fluid is present, so that the erosive fluid does not reach the environment.

In another feature of the invention, the fluid is carried in closed loop circulation, thus reducing the consumption of erosive fluid.

BRIEF DESCRIPTION OF THE DRAWINGS

Further advantages and features of the invention can be learned from the ensuing description, taken with the drawings, in which.

DESCRIPTION OF THE PREFERRED EMBODIMENTS

Figure 1:
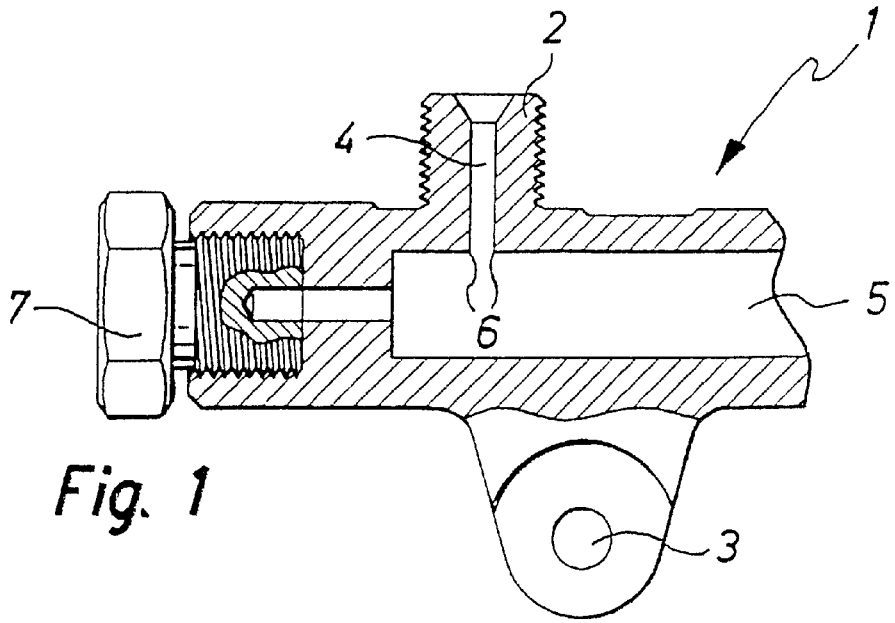
FIG. 1 is a cylindrical high-pressure fuel reservoir of the prior art, in fragmentary longitudinal section.

In FIG. 1, a high-pressure fuel reservoir 1 of the prior art is shown in fragmentary longitudinal section. The high-pressure fuel reservoir 1 has one or more connection stubs 2, only one of which is shown in FIG. 1. A fastening tab 3 is also visible. The connection stub 2 has a bore 4, which hydraulically connects the connection stub 2 to the storage chamber 5. Severe mechanical stresses, which can cause breakage, occur in operation at an edge 6 that results from the intersection between the bore 4 and the storage chamber 5. A tried and true means of abating these stresses is to round off the edge 6. Because of the geometric conditions, this is possible only conditionally if at all with counterbores or the like. In any case, it involves high costs.

With the aid of the method of the invention, the rounding off can be done simply, effectively, economically, and quickly, with cycle times from 20 seconds to 200 seconds. To that end, instead of a closure screw 7, a hydraulic communication, not shown, with a feed pump, also not shown, is established. The feed pump pumps an erosive fluid into the high-pressure fuel reservoir 1 that is carried away through the bore 4. In the region of the edge 6, because of the narrowing of the cross section, the flow speed of the fluid increases. Because of the high flow speed of the fluid, the edge 6 is rounded off by the erosive fluid. In the method of the invention, the removal of material at sharp edges is greater than at dull edges or faces. The inner wall of the high-pressure fuel reservoir 1 is not removed at all, because in accordance with Newton's condition of adhesion, the flow speed equals zero.

By adjusting the feed pressure of the feed pump, the flow speed and thus the removal of material as well can be varied. In practice, feed pressures between 50 bar and 140 bar have proved to be suitable.

Figure 2:
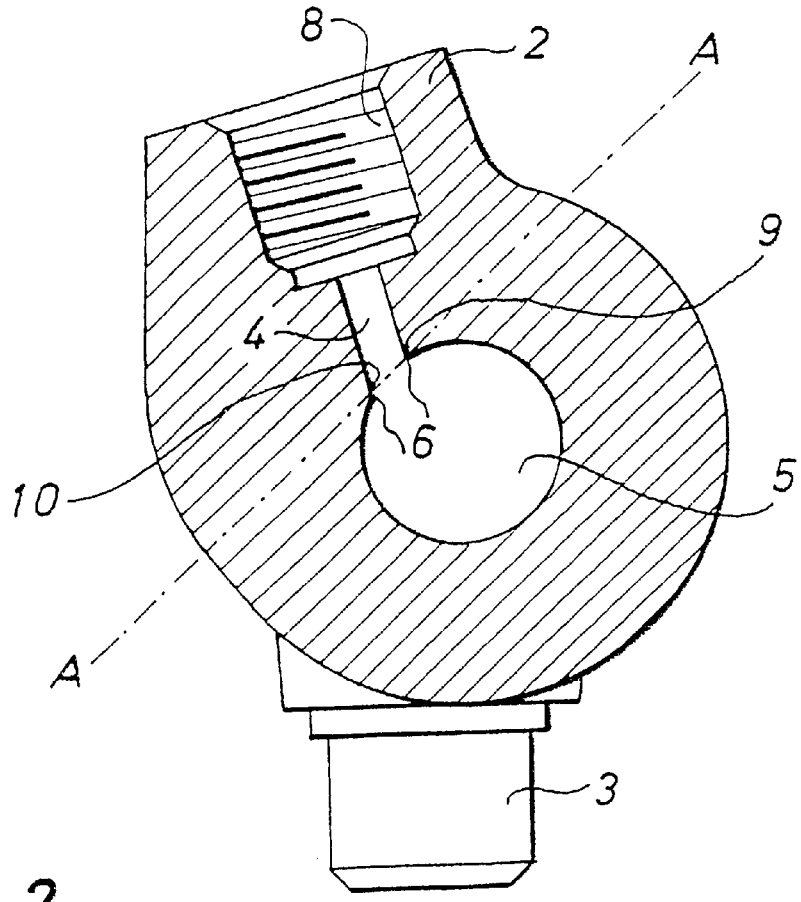
FIG. 2 is a cross section through a high-pressure fuel reservoir of the invention.

In FIG. 2, a cross section through a further version of a high-pressure fuel reservoir 1 is shown. The connection stub 2 has a female thread 8, into which a high-pressure line, not shown, can be screwed.

Since the bore 4 does not discharge into the storage chamber 5 at a right angle, the edge 6 is not equally sharp, viewed around the circumference of the bore 4. It is sharpest at the point marked 9, while it is markedly duller at the point marked 10. After the rounding off according to the invention, the high-pressure fuel reservoir 1 was cut open in the plane marked A—A and examined. It was found that the edge 6 was rounded off the most at the point 9, while the removal of material was less at the point 10.

Figure 3:
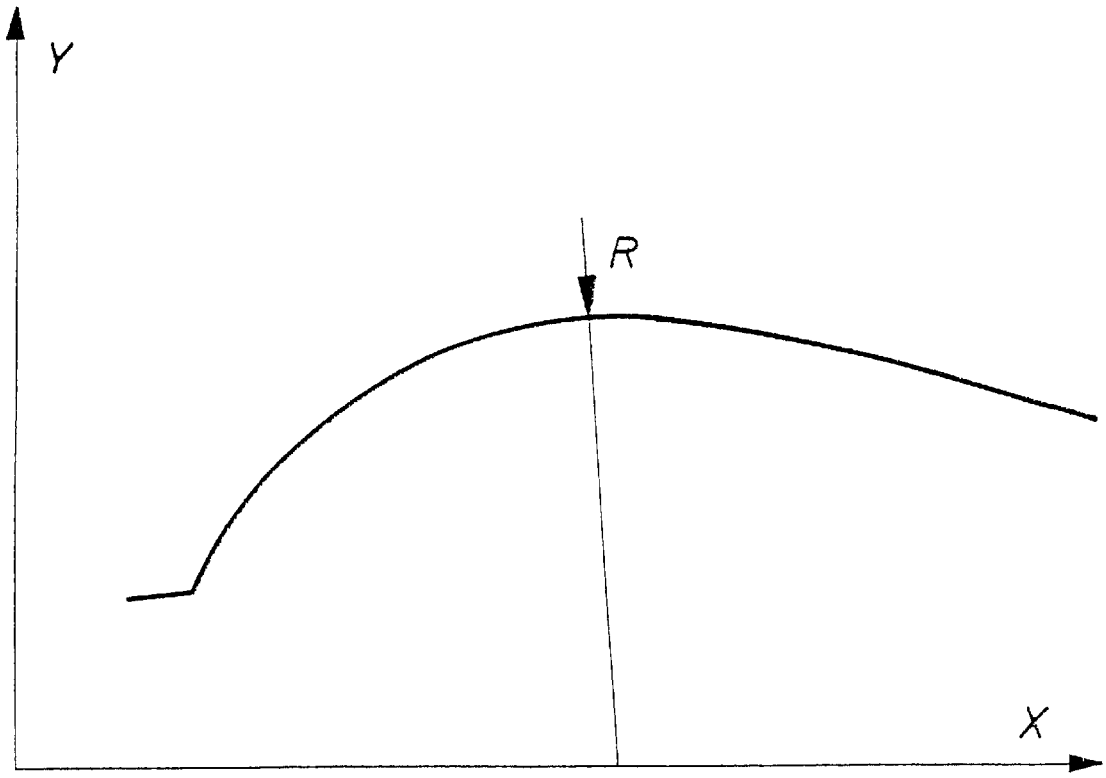
FIG. 3 is an X-Y graph illustrating the course of the contour of an edge rounded off according to the invention.

FIG. 3 shows the outcome of a measurement of the rounding off in the plane A—A after the method of the invention was applied at the sharp-edged point 9. This graph shows the rounding contour of the sharp-edged point 9 in FIG. 2 (Y axis), plotted over the direction of motion of the measuring scanner (X axis). The radius of curvature R is 0.782 mm.

Figure 4:
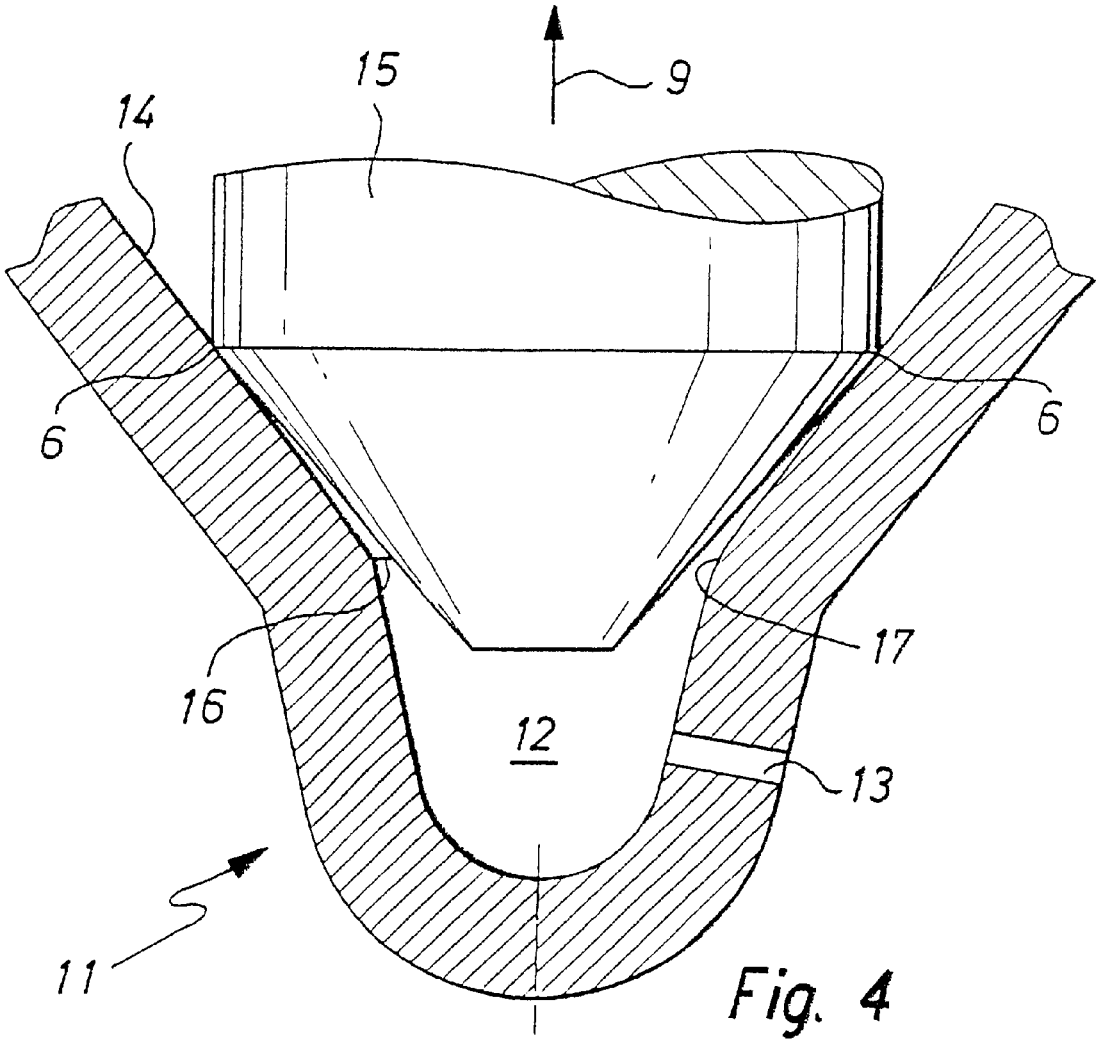
FIG. 4 is a cross section through a blind bore injection nozzle rounded off according to the invention.

In FIG. 4, an injection nozzle 11 for a fuel injection system is shown, with a conical blind bore 12. Via an injection port 13, the fuel, not shown, passes from the blind bore 12 into the combustion chamber, also not shown. The conical blind bore 12 is adjoined by a frustoconical nozzle needle seat 14.

On the left-hand side of FIG. 4, a transition between the blind bore 12 and the nozzle needle seat 14 in the prior art is shown in the form of an edge 16. This edge 16 is created in the grinding of the nozzle needle seat 14. Depending on the type of machining, the edge 16 can be either a sharp burr or a smooth edge.

On the right-hand side of FIG. 4, a transition 17 between a blind bore 12 and a nozzle needle seat 14 is shown that is rounded off according to the invention. To that end, an erosive fluid is pumped through the injection port 13 from the nozzle needle seat 14. To achieve the highest possible flow speed in the region of the edge 16 or of the rounded-off transition 17, in the rounding process a body 15, which is for instance of ceramic and whose geometry is essentially equivalent to a nozzle needle, is introduced into the injection nozzle 11. When the body 15 is lifted slightly from the nozzle needle seat 14, the flow speed of the erosive fluid, not shown, is highest, because of the continuity equation, in the region of the edge 16, that is, the rounded-off transition 17. As a consequence, the most material is also eroded there, as a consequence rounding off is brought about above all there.

It has proved to be especially advantageous to use a suspension of a grinding agent in oil as the erosive fluid. Especially in conjunction with a pressure difference of from 50 bar to 140 bar, a removal of material thus results that is very much greater compared to the method known from the prior art. The method of the invention is thus more economical and can be used more widely.

In principle, edges of any type at outer contours or inner contours can be rounded off with the aid of a body 15 or without such a body, if the flow speed in the region of the edges 6 or 16 is high enough. Since the flow speed of the fluid needs to be high only in the region of the edges 6 or 16, the removal of material performed by the erosive fluid at the other points of the workpiece as well as of the pump and other equipment is very slight. This lengthens the service life of all these elements.

The foregoing relates to preferred exemplary embodiment of the invention, it being understood that other variants and embodiments thereof are possible within the spirit and scope of the invention, the latter being defined by the appended claims.

We claim:

1. A method for deburring edges and rounding off edges, comprising, subjecting the edge (6, 16) to be deburred and rounded off with an erosive fluid which is made to flow past the edge, in which the erosive fluid is made to flow in such a manner that a pressure difference of from 50 bar to 140 bar exists between the pressures of the erosive fluid before and after it passes the edge (6, 16) to be deburred and rounded off.

2. The method of claim 1, wherein the flow speed of the fluid closely adjacent the edge (6, 16) to be rounded off is elevated compared to the average flow speed of the fluid.

3. The method of claim 2, further comprising introducing a body (15) into the fluid to thereby form a gap between the surface of the body and the edge (16) to be rounded off.

4. The method of claim 1, wherein the flow direction of the fluid and the longitudinal axis of the edge to be rounded off extend at an angle to one another.

5. The method of claim 1, wherein a suspension of a grinding agent in oil is employed as the erosive fluid.

6. The method of claim 2, wherein the flow direction of the fluid and the longitudinal axis of the edge to be rounded off extend at an angle to one another.

7. The method of claim 3, wherein the flow direction of the fluid and the longitudinal axis of the edge to be rounded off extend at an angle to one another.

8. The method of claim 2, wherein a suspension of a grinding agent in oil is employed as the erosive fluid.

9. The method of claim 3, wherein a suspension of a grinding agent in oil is employed as the erosive fluid.

10. The method of claim 4, wherein a suspension of a grinding agent in oil is employed as the erosive fluid.

11. An apparatus for performing the method of claim 1, the apparatus comprising a feed pump for the erosive fluid, said feed pump producing a feed pressure of between 50 bar and 140 bar, and having a hydraulic communication between the feed pump and the component (1, 11) whose edge (6, 16) is to be rounded off.

12. The apparatus of claim 11, further comprising a body forming a gap with the edge (6, 16) to be rounded off.

13. The apparatus of claim 11, further comprising a collector device for catching the fluid.

14. The apparatus of claim 11, wherein the fluid is carried in closed loop circulation.

15. The apparatus of claim 12, further comprising a collector device for catching the fluid.

16. The apparatus of claim 12, wherein the fluid is carried in closed loop circulation.

17. The apparatus of claim 13, wherein the fluid is carried in closed loop circulation.

* * * * *